US011537067B2

(12) United States Patent
Arata

(10) Patent No.: US 11,537,067 B2
(45) Date of Patent: Dec. 27, 2022

(54) INTERMEDIATE TRANSFER UNIT AND IMAGE FORMING APPARATUS THEREWITH

(71) Applicant: KYOCERA Document Solutions Inc., Osaka (JP)

(72) Inventor: Tatsuro Arata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/701,458

(22) Filed: Mar. 22, 2022

(65) Prior Publication Data

US 2022/0342350 A1 Oct. 27, 2022

(30) Foreign Application Priority Data

Apr. 21, 2021 (JP) ..... JP2021-071549

(51) Int. Cl.
*G03G 15/01* (2006.01)
*G03G 15/16* (2006.01)
*G03G 21/16* (2006.01)

(52) U.S. Cl.
CPC ..... *G03G 15/1615* (2013.01); *G03G 15/161* (2013.01); *G03G 21/168* (2013.01)

(58) Field of Classification Search
CPC ..... G03G 15/1615; G03G 21/168
USPC ..... 399/121, 302
See application file for complete search history.

(56) References Cited

U.S. PATENT DOCUMENTS 6,731,895 B2 * 5/2004 Hamada et al. ... G03G 15/1615 399/302
9,651,898 B2 * 5/2017 Hatano ..... G03G 21/168

FOREIGN PATENT DOCUMENTS

JP 2017-32710 A 2/2017

* cited by examiner

*Primary Examiner* — William J Royer
(74) *Attorney, Agent, or Firm* — Stein IP, LLC

(57) ABSTRACT

An intermediate transfer unit includes an intermediate transfer belt, a driving roller, a tension roller, and a roller supporting frame. The roller supporting frame includes first and second supporting frames, and has a coupling portion formed on it. The coupling portion includes a rotary shaft and a shaft hole. The roller supporting frame shifts from a first state to a second state by rotating the first supporting frame in the forward direction to have the intermediate transfer belt wound around it. The rotary shaft includes a projection. A shaft hole has a restricting wall portion. As the first supporting frame in the second state rotates in the forward direction, the projection makes contact with the restricting wall portion to restrict rotation of the first supporting frame in the forward direction.

6 Claims, 10 Drawing Sheets

INTERMEDIATE TRANSFER UNIT AND IMAGE FORMING APPARATUS THEREWITH

INCORPORATION BY REFERENCE

This application is based upon and claims the benefit of priority from the corresponding Japanese Patent Application No. 2021-071549 filed on Apr. 21, 2021, the entire contents of which are hereby incorporated by reference.

BACKGROUND

The present disclosure relates to an intermediate transfer unit and an image forming apparatus provided with an intermediate transfer unit.

There is conventionally known an intermediate transfer-type image forming apparatus including an endless intermediate transfer belt that rotates in a prescribed direction and a plurality of image forming portions provided along the intermediate transfer belt. In the image forming apparatus, by the image forming portions, toner images of different colors are sequentially superimposed on the intermediate transfer belt, and those toner images are then transferred to a recording medium at once.

Such an image forming apparatus of the intermediate transfer-type includes an intermediate transfer unit. The intermediate transfer unit includes an intermediate transfer belt and a plurality of primary transfer members. The primary transfer members face photosensitive drums for different colors across the intermediate transfer belt. Predetermined primary transfer biases are applied to the primary transfer members, and the toner images formed on the photosensitive drums are primarily transferred to the intermediate transfer belt.

The intermediate transfer unit includes a roller supporting frame. At one end of the roller supporting frame, a driving roller is provided, and at the other end, a tension roller is provided. The intermediate transfer belt is wound around the driving roller and the tension roller. The driving roller rotates the intermediate transfer belt. The tension roller gives a predetermined tension to the intermediate transfer belt.

The roller supporting frame includes a first supporting frame, a second supporting frame, and a coupling portion. The coupling portion rotatably couples end parts of the first and second supporting frames together. The coupling portion includes a rotary shaft and a shaft hole. The rotary shaft is provided on one of the first and second supporting frames and projects toward the other of the first and second supporting frames. A shaft hole is a hole formed in the other of the first and second supporting frames. The rotary shaft is inserted in the shaft hole.

To assemble such an intermediate transfer unit, first, the first supporting frame is rotated with respect to the second supporting frame so that the roller supporting frame is brought into a bent state (a first state). Then, the bent roller supporting frame is inserted inside the endless intermediate transfer belt. Next, the first supporting frame is rotated in the forward direction about the rotary shaft to bring the roller supporting frame into a linearly extending state (a second state), and the intermediate transfer belt is wound around the roller supporting frame.

SUMMARY

According to one aspect of the present disclosure, an intermediate transfer unit includes an intermediate transfer belt, a driving roller, a tension roller, and a roller supporting frame. The intermediate transfer belt is endless and moves along a plurality of image forming portions. The driving roller rotates the intermediate transfer belt. The tension roller rotates by following the intermediate transfer belt w % bile giving a predetermined tension to the intermediate transfer belt. The roller supporting frame includes a first supporting frame which supports on its one end one of the tension roller and the driving roller and a second supporting frame which supports on its one end the other of the tension roller and the driving roller. The roller supporting frame has a coupling portion formed on it which rotatably couples together an end part of the first supporting frame on which the one roller is not supported and an end part of the second supporting frame on which the other roller is not supported. The coupling portion has a rotary shaft formed on the first supporting frame and a shaft hole formed in the second supporting frame to permit the rotary shaft to be inserted in it. The roller supporting frame is inserted inside the intermediate transfer belt in a first state where the first and second supporting frames are folded so as to form an acute angle. The roller supporting frame makes the first supporting frame rotate with respect to the second supporting frame about the rotary shaft in a forward direction such that the roller supporting frame in the first state is brought into a second state where the first and second supporting frames extend linearly. The roller supporting frame has the intermediate transfer belt wound around the driving roller and the tension roller. In this intermediate transfer unit, the rotary shaft has a projecting portion that projects from its outer circumferential face in the radial direction. The shaft hole has a restricting wall portion which is formed outward of the rotary shaft in the radial direction, downstream of the projecting portion in the forward direction. As the first supporting frame in the second state rotates in the forward direction, the projection makes contact with the restricting wall portion to restrict rotation of the first supporting frame in the forward direction.

DETAILED DESCRIPTION

Figure 1:
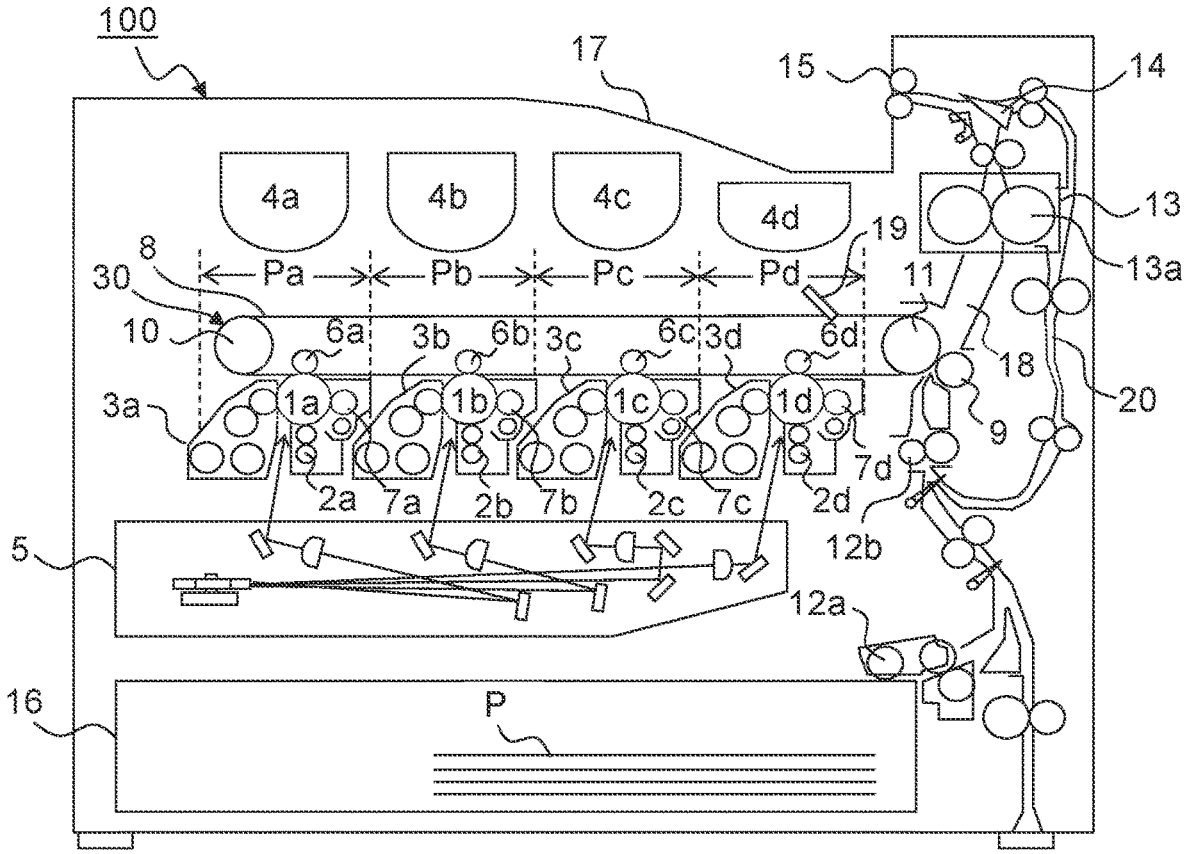
FIG. 1 is a schematic diagram showing a construction of an image forming apparatus 100 provided with an intermediate transfer unit 30 according to the present disclosure.
Figure 2:
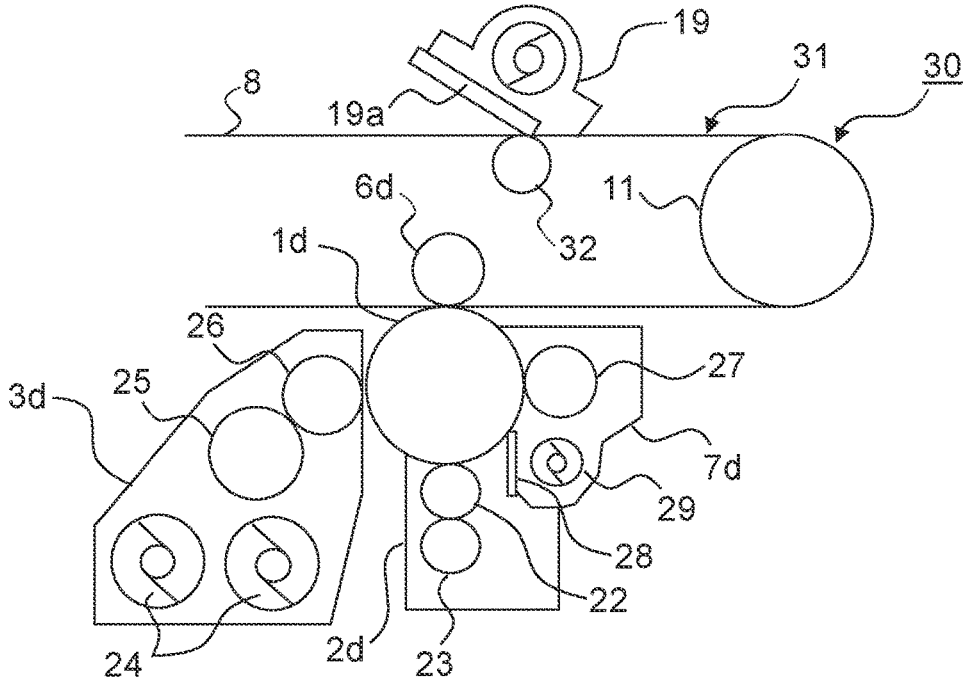
FIG. 2 is an enlarged view of and around an image forming portion Pd in FIG. 1.

Hereinafter, with reference to the accompanying drawings, embodiments of the present disclosure will be described. FIG. 1 is a schematic diagram showing the configuration of an image forming apparatus 100 including an intermediate transfer unit 30 according to the present disclosure, and FIG. 2 is an enlarged view of and around an image forming portion Pd in FIG. 1.

The image forming apparatus 100 in FIG. 1 is constructed as follows. In a main body of the image forming apparatus 100, four image forming portions Pa, Pb, Pc and Pd are arranged in this order from upstream in a conveying direction (from the left side in FIG. 1). The image forming portions Pa to Pd are provided so as to correspond to images of four different colors (cyan, magenta, yellow, and black). The image forming portions Pa to Pd sequentially form images of cyan, magenta, yellow, and black through the processes of electrostatic charging, exposure, developing, and transfer.

In the image forming portions Pa to Pd, photosensitive drums 1*a*, 1*b*, 1*c*, and 1*d* are respectively arranged which carry visible images (toner images) of the different colors. The photosensitive drums 1*a* to 1*d* are rotatably supported. The intermediate transfer unit 30 including an intermediate transfer belt 8 is arranged so as to be adjacent to the image forming portions Pa to Pd.

Typically used as the intermediate transfer belt 8 is a belt with no seams (seamless belt) formed of a sheet of dielectric resin. The surface of the intermediate transfer belt 8 is in contact with the outer circumferential face of the photosensitive drums 1*a* to 1*d*. The intermediate transfer unit 30, with a drive motor (omitted from illustration), rotates the intermediate transfer belt 8 counter-clockwise in FIGS. 1 and 2 via a driving roller 11 that will be described later. The intermediate transfer unit 30 will be described in detail later.

A secondary transfer roller 9 is provided adjacent to the intermediate transfer unit 30. A fixing portion 13 is provided downstream of the secondary transfer roller 9 in the conveying direction of a transfer paper P (including a recording medium such as a printing sheet, an envelope, and an OHP). The transfer paper P is stored in a sheet cassette 16 arranged in a lower part in the image forming apparatus 100. The transfer paper P is conveyed via a sheet feeding roller 12*a* and a pair of registration rollers 12*b* to the secondary transfer roller 9.

Next, image forming portions Pa to Pd will be described using FIGS. 1 and 2. Provided around and under the photosensitive drums 1*a* to 1*d* are a belt cleaning unit 19, primary transfer rollers 6*a* to 6*d*, chargers 2*a* to 2*d*, an exposure unit 5, developing units 3*a* to 3*d*, and cleaning devices 7*a* to 7*d*.

The belt cleaning unit 19 is arranged downstream of the photosensitive drum 1*d* in the rotation direction of the intermediate transfer belt 8. The belt cleaning unit 19 includes a belt cleaning blade 19*a* for removing the residual toner remaining on the surface of the intermediate transfer belt 8.

The primary transfer rollers 6*a* to 6*d* face the photosensitive drums 1*a* to 1*d* respectively across the intermediate transfer belt 8. The chargers 2*a* to 2*d* electrically charge the photosensitive drums 1*a* to 1*d*. The exposure unit 5 exposes the photosensitive drums 1*a* to 1*d* to light carrying image information.

The developing units 3*a* to 3*d* form toner images on the photosensitive drums 1*a* to 1*d*. The developing units 3*a* to 3*d* are loaded by a supply device (not shown) with predetermined amounts of toner of magenta, cyan, yellow, and black stored in toner containers 4*a* to 4*d* respectively. The cleaning devices 7*a* to 7*d* remove developer (toner) left on the photosensitive drums 1*a* to 1*d*.

Next, the image forming portions Pa to Pd will be described in more detail. Here, the image forming device Pd will be taken as an example. Since the image forming portions Pa to Pc have basically similar structures, no overlapping description will be repeated. As shown in FIG. 2, the charger 2*d* includes a charging roller 22 which makes contact with the photosensitive drum 1*d* to apply a charging bias to the surface of the photosensitive drum 1*d* and a charging cleaning roller 23 which cleans the charging roller 22.

The developing unit 3*d* includes two stirring/conveying screws 24, a magnetic roller 25, and a developing roller 26. The developing unit 3*d* applies a developing bias having the same (positive) polarity toner to the developing roller 26 to make the toner fly to the surface of the photosensitive drum 1*d*.

The cleaning device 7*d* includes a rubbing roller 27, a cleaning blade 28, and a collection screw 29. The rubbing roller 27 is kept in pressed contact with the photosensitive drum 1*a* with a predetermined pressure and is driven by a driving device (omitted from illustration) to rotate in the same direction as the photosensitive drum 1*d* at a contact face with it. The cleaning blade 28 is fixed in contact with a part on the surface of the photosensitive drum 1*d*, downstream of the contact face with the rubbing roller 27 in the rotation direction.

The rubbing roller 27 and the cleaning blade 28 remove unused toner off the surface of the photosensitive drum 1*d*. The removed unused toner is discharged outside the cleaning device 7*d* as the collection screw 29 rotates and is conveyed to the toner collection container (not shown) and stored it.

Next, a description will be given of an image forming procedure on the image forming apparatus 100. When a user enters an instruction to start image formation, first, the chargers 2*a* to 2*d* electrostatically charge the surfaces of the photosensitive drums 1*a* to 1*d* uniformly. Next, the exposure unit 5 irradiates the surfaces of the photosensitive drums 1*a* to 1*d* with light to form on them electrostatic latent images reflecting an image signal.

Then, the developing units 3*a* to 3*d* feed the photosensitive drums 1*a* to 1*d* with toner, which electrostatically adheres to the photosensitive drums 1*a* to 1*d*. Thus, toner images corresponding to the electrostatic latent images on the photosensitive drums 1*a* to 1*d* are formed.

Then, an electric field with a predetermined transfer voltage is applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. These images of four colors are formed in a predetermined positional relationship with each other that is prescribed for formation of a predetermined full-color image. Then, in preparation for the subsequent formation of new electrostatic latent images, toner left on the surface of the photosensitive drums 1*a* to 1*d* are removed by the cleaning devices 7*a* to 7*d*.

As the driving roller 11, which will be described later, is rotated by a drive motor (not shown), the intermediate transfer belt 8 starts to rotate counter-clockwise. Then, the transfer paper P is conveyed to the secondary transfer roller 9 via the registration rollers 12*b* with predetermined timing, and the full-color image is transferred to the transfer paper P. The transfer paper P on which the toner images have been transferred passes through a sheet conveying passage 18 to be conveyed to the fixing portion 13. Toner remaining on the surface of the intermediate transfer belt 8 is removed by the belt cleaning unit 19.

The transfer paper P conveyed to the fixing portion 13 is heated and pressed by a fixing roller pair 13*a*, and thereby the toner images are fixed on the surface of the transfer paper P to form a predetermined full-color image. The transfer paper P on which the full-color image has been formed has its conveyance direction switched by a branch portion 14 branching into a plurality of directions. When an image is formed only on one side of the transfer paper P, the transfer paper P is directly discharged onto a discharge tray 17 by a discharge roller 15.

In contrast, when images are formed on both sides of the transfer paper P, part of the transfer paper P that has passed through the fixing portion 13 is momentarily stuck out of the image forming apparatus 100 through the discharge roller 15. Then, as the discharge roller 15 rotates reversely, the transfer paper P is directed to a reversing conveying passage 20 at the branch portion 14, and is conveyed again to the secondary transfer roller 9 with the image face reversed. Then, the next image formed on the intermediate transfer belt 8 is transferred by the secondary transfer roller 9 to the face of the transfer paper P on which no image has yet been formed. The transfer paper P is then conveyed to the fixing portion 13 to have the toner images fixed on it, and is discharged to the discharge tray 17.

Figure 3:
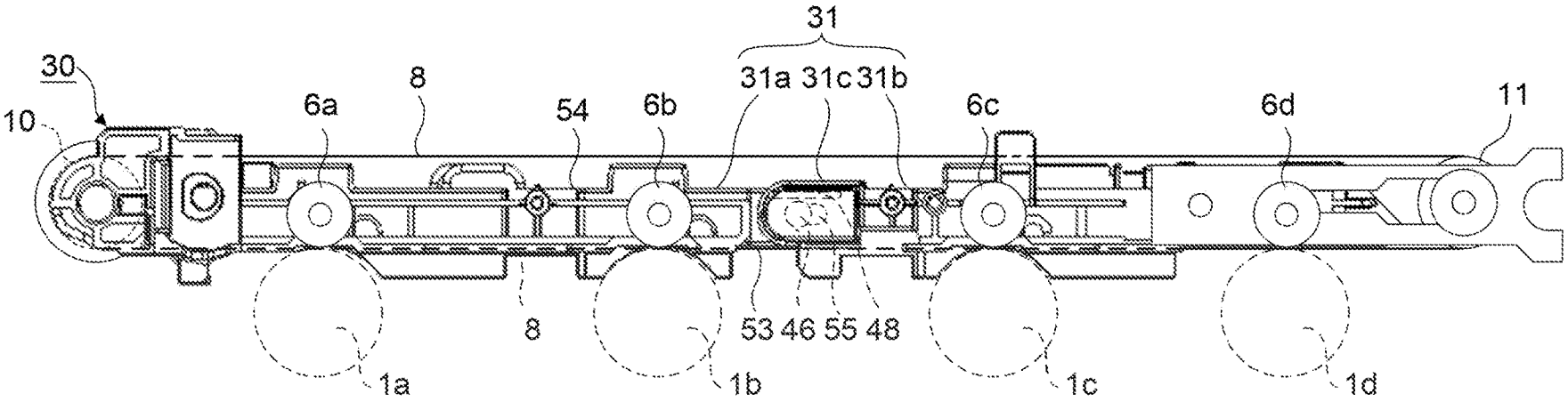
FIG. 3 is a side view showing a side face of the intermediate transfer unit 30 in a second state.
Figure 4:
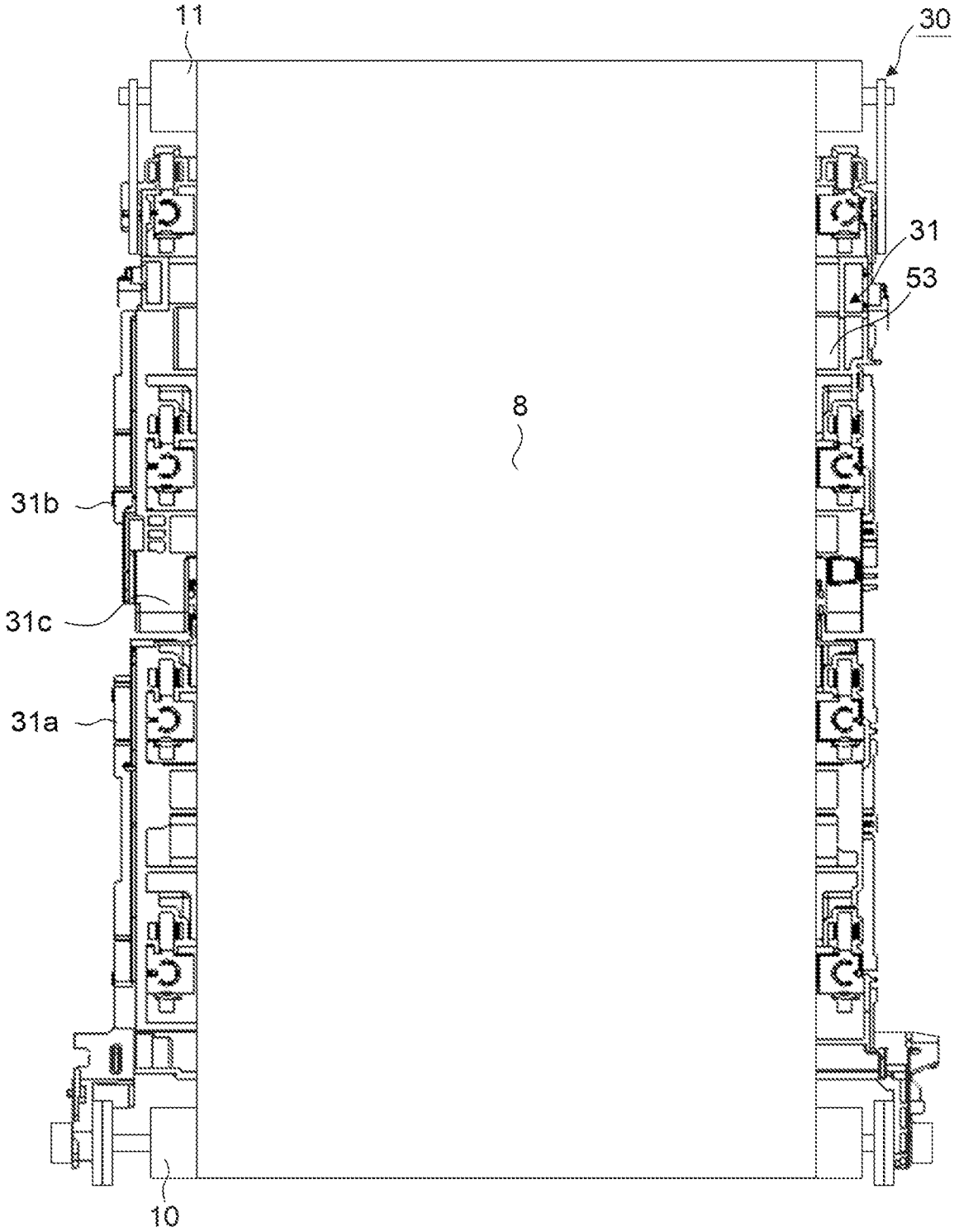
FIG. 4 is a plan view of the intermediate transfer unit 30 in the second state.
Figure 5:
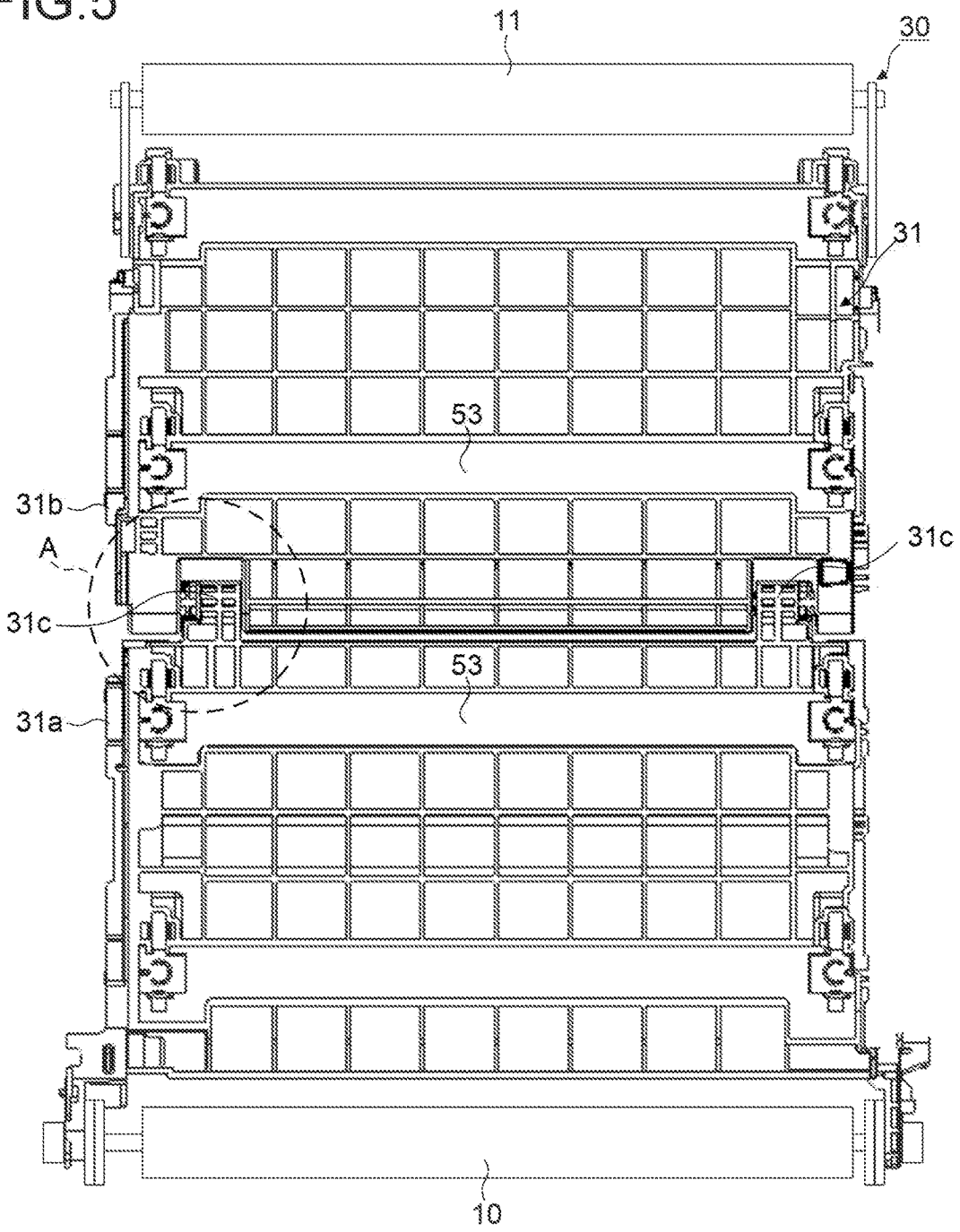
FIG. 5 is a plan view of the intermediate transfer unit 30 in FIG. 4 with an intermediate transfer belt 8 removed from it.
Figure 6:
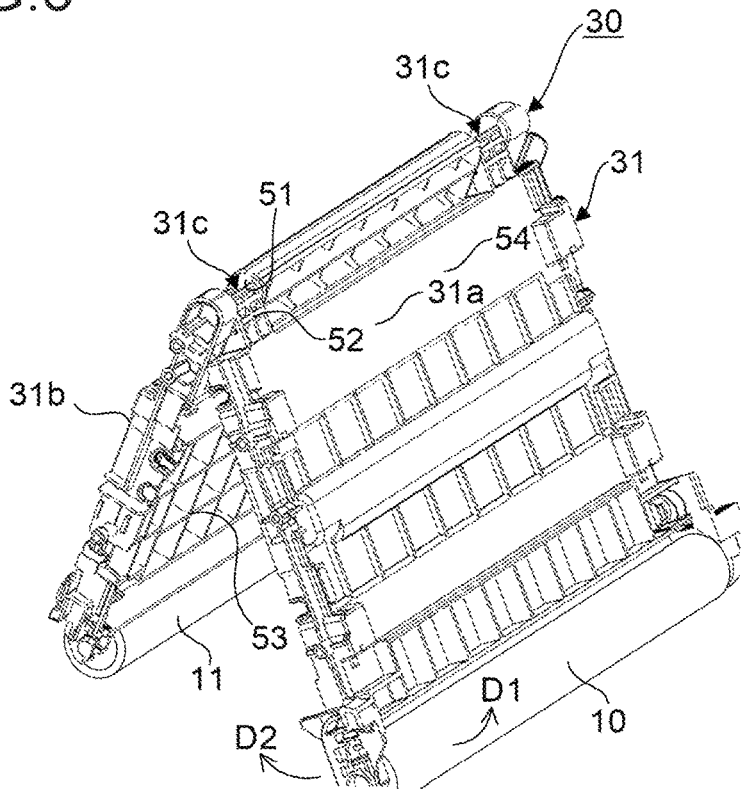
FIG. 6 is a perspective view of the intermediate transfer unit 30 in a folded state with the intermediate transfer belt 8 removed from it.

Next, the intermediate transfer unit 30 will be described in detail. FIG. 3 is a side view of the intermediate transfer unit 30 in a stretched state (a second state described later). FIG. 4 is a plan view of the intermediate transfer unit 30 in the stretched state. FIG. 5 is a plan view of the intermediate transfer unit 30 in FIG. 4 with the intermediate transfer belt 8 removed from it. FIG. 6 is a perspective view of the folded intermediate transfer unit 30 with the intermediate transfer belt 8 removed from it.

As shown in FIGS. 3 to 5, the intermediate transfer unit 30 includes, in addition to the intermediate transfer belt 8 described above, a roller supporting frame 31, a tension roller 10, the driving roller 11, and primary transfer rollers 6*a* to 6*d*. The tension roller 10 is supported at one end of the roller supporting frame 31. The driving roller 11 is supported at the other end of the roller supporting frame 31. The primary transfer rollers 6*a* to 6*d* are supported on the roller supporting frame 31 at positions between the tension roller 10 and the driving roller 11.

The intermediate transfer belt 8 is wound around the tension roller 10 and the driving roller 11. The primary transfer rollers 6*a* to 6*d* make contact with the photosensitive drums 1*a* to 1*d* respectively via the intermediate transfer belt 8. The intermediate transfer unit 30 can be inserted into and drawn out of the main body of the image forming apparatus 100 horizontally through a side face (at right in FIG. 1) of the image forming apparatus 100.

The roller supporting frame 31 includes a first supporting frame 31*a*, a second supporting frame 31*b*, and a coupling portion 31*c*. The coupling portion 31*c* rotatably couples the first and second supporting frames 31*a* and 31*b* together.

The coupling portion 31*c* is located between the first and second supporting frames 31*a* and 31*b*, that is, in a central part of the roller supporting frame 31 in the stretched state (second state). By rotating the first roller supporting frame 31*a* with respect to the second supporting frame 31*b*, the roller supporting frame 31 can be transformed between a state where it is folded at the coupling portion 31*c* (the state shown in FIG. 6; hereinafter, this state is referred to also as a first state) and the stretched state where the first and second supporting frames 31*a* and 31*b* extend linearly (the state shown in FIG. 5; this state is referred to also as the second state).

As shown in FIG. 3, when the intermediate transfer unit 30 is in the second state, the first and second supporting frames 31*a* and 31*b* are linearly arranged. Hereinafter, the direction in which the first and second supporting frames 31*a* and 31*b* are linearly arranged (the left-right direction in FIG. 3) in the second state is referred to as the longitudinal direction of the roller supporting frame 31 and the first and second supporting frames 31*a* and 31*b*. The direction perpendicular to the longitudinal direction (the direction perpendicular to the plane of FIG. 3) is referred to as the width direction of the roller supporting frame 31 and the first and second supporting frames 31*a* and 31*b*.

The intermediate transfer unit 30 mounted in the image forming apparatus 100 faces the photosensitive drums 1*a* to 1*d* in the up-down direction (see FIG. 1). Hereinafter, of the opposite end faces of the roller supporting frame 31 in the up-down direction, the face closer to the photosensitive drums 1*a* to 1*d* is referred to as an obverse face 53, and the face farther from the photosensitive drums 1*a* to 1*d* is referred to as a reverse face 54. As shown in FIG. 6, w % ben the roller supporting frame 31 is in the first state, the obverse face 53 lies on the inner sides (facing each other) of the first and second supporting frames 31*a* and 31*b*, and the reverse face 54 lies on the outer sides of the first and second supporting frames 31*a* and 31*b*.

The tension roller 10 is rotatably supported on an end portion of the first supporting frame 31*a* at one side in the longitudinal direction (one end of the roller supporting frame 31). The tension roller 10, with the intermediate transfer belt 8 wound around the roller supporting frame 31, gives a predetermined tension to the intermediate transfer belt 8. The driving roller 11 is rotatably supported on an end portion of the second supporting frame 31*b* at one side in the longitudinal direction (an end portion at the side opposite to the end portion supporting the tension roller 10 in the roller supporting frame 31). The outer diameter (diameter) of the driving roller 11 is equal to the outer diameter of the tension roller 10. The driving roller 11 is kept in pressed contact with the intermediate transfer belt 8 in a state where the intermediate transfer belt 8 is wound around the roller supporting frame 31, and, in this state, is rotated by the drive motor (omitted from illustration) to rotate the intermediate transfer belt 8.

On the roller supporting frame 31, between the tension roller 10 and the coupling portion 31*c*, the primary transfer rollers 6*a* and 6*b* are supported in this order from the tension roller 10 side. On the roller supporting frame 31, between the driving roller 11 and the coupling portion 31*c*, the primary transfer rollers 6*c* and 6*d* are supported in this order from the coupling portion 31*c* side. Obliquely above the primary transfer roller 6*d*, a counter-roller 32 facing the belt cleaning blade 19*a* (see FIG. 2) in the belt cleaning unit 19 is supported.

Figure 7:
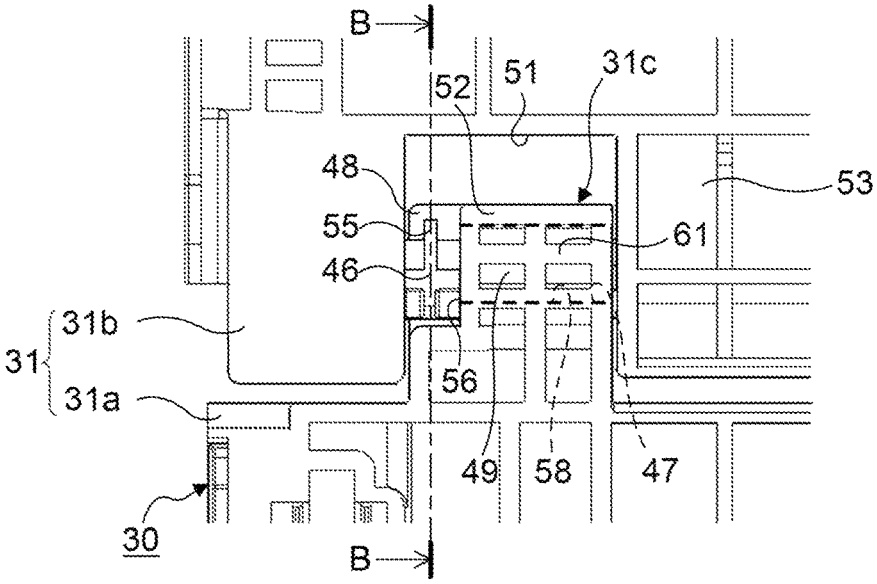
FIG. 7 is a partly enlarged view of and around a coupling portion 31*c* of a roller supporting frame 31 (the part inside the dash-dot line circle A in FIG. 5) shown in FIG. 5.
Figure 8:
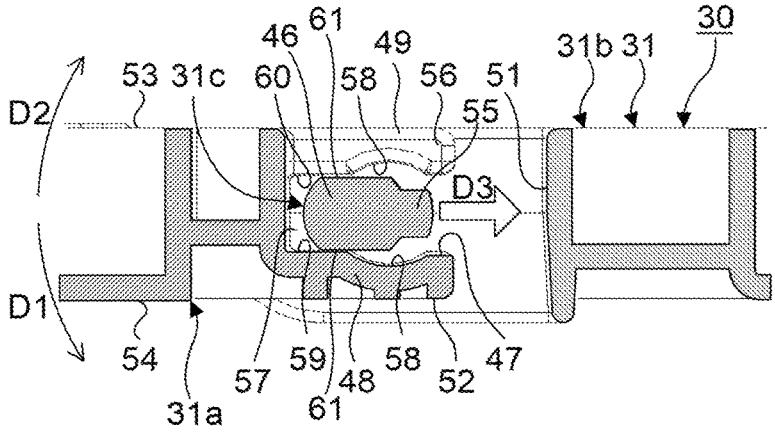
FIG. 8 is a cross-sectional view of the roller supporting frame 31 shown in FIG. 7 cut along section line B-B.
Figure 9:
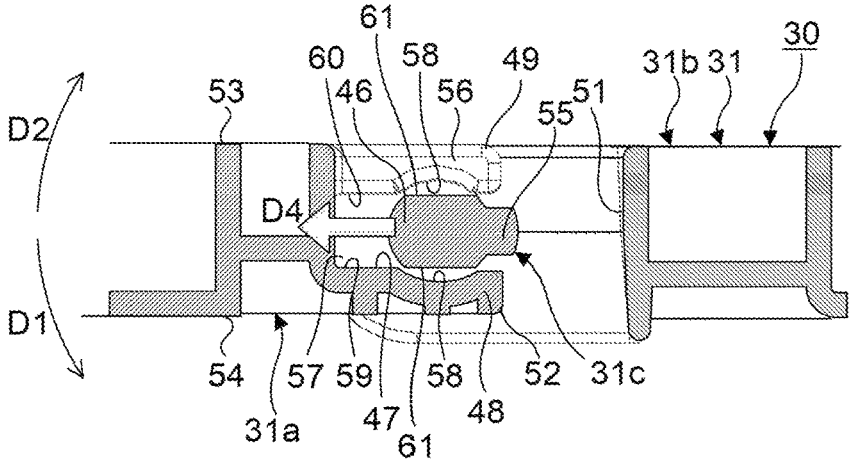
FIG. 9 is a cross-sectional view showing a state where a rotary shaft 46 is inserted in a supporting recess 58.

FIG. 7 is a partly enlarged view of and around the coupling portion 31*c* of the roller supporting frame 31 (the part inside the dash-dot line circle A in FIG. 5) shown in FIG. 5. FIG. 8 is a cross-sectional view of the roller supporting frame 31 shown in FIG. 7 cut along section line B-B. FIG. 9 is a cross-sectional view showing a state where a rotary shaft 46 is inserted in a supporting recess 58.

As shown in FIGS. 6 to 8, in an end portion of the first supporting frame 31*a* at the other side in the longitudinal direction (in an end portion at the side opposite to the end portion supporting the tension roller 10), a coupling protrusion 52 is formed. In an end portion of the second supporting frame 31*b* on the other side in the longitudinal direction (in an end portion on the side opposite to the end portion supporting the driving roller 11), a coupling recess 51 is formed.

The coupling protrusion 52 projects in its longitudinal direction. The coupling recess 51 is recessed in the longitudinal direction of the second supporting frame 31*b*. The distance between the faces of the coupling recess 51 that face each other in the width direction is larger than the dimension of the coupling protrusion 52 in the width direction. The coupling protrusion 52 is inserted in the coupling recess 51.

The coupling protrusion 52 includes a restricting wall portion 48 and a vertical wall portion 49 (see FIG. 8). The restricting wall portion 48 projects in the longitudinal direction from a side end part on the reverse face 54 side. The vertical wall portion 49 projects in the longitudinal direction from a side end part on the obverse face 53 side. The restricting wall portion 48 and the vertical wall portion 49 face each other in the thickness direction of the first supporting frame 31*a* (the direction perpendicular to the longitudinal and width directions of the first supporting frame 31*a*).

The coupling portion 31*c* includes the rotary shaft 46 and a shaft hole 47. The rotary shaft 46 is provided in the coupling recess 51 in the first supporting frame 31*a*. The shaft hole 47 is formed between the restricting wall portion 48 and the vertical wall portion 49. The rotary shaft 46 is inserted in the shaft hole 47.

The rotary shaft 46 is a cylindrical shaft member that extends in the width direction of the first supporting frame 31*a*. On the rotary shaft 46, flat faces 61 are formed. The flat faces 61 are formed one at each of the opposite sides of the second supporting frame 31*b* in the thickness direction (the direction perpendicular to the longitudinal and width directions of the second supporting frame 31*b*) across the center of the rotary shaft 46. The flat faces 61 are parallel to the obverse and reverse faces 53 and 54 of the second supporting frame 31*b*.

The shaft hole 47 includes a fixing portion 57 and the supporting recess 58. The fixing portion 57 can hold the rotary shaft 46 such that the first and second supporting frames 31*a* and 31*b* are coupled and fixed together. The supporting recess 58 rotatably supports the rotary shaft 46. The fixing portion 57 and the supporting recess 58 are located side by side in the longitudinal direction of the first supporting frame 31*a*.

The fixing portion 57 includes opposed faces 59 and 60. The opposed face 59 faces the vertical wall portion 49 formed on the restricting wall portion 48. The opposed face 60 faces the restricting wall portion 48 formed on the vertical wall portion 49. The distance between the opposed faces 59 and 60 is equal to the dimension between one flat face 61 and the other flat face 61 formed on the rotary shaft 46. The supporting recess 58 is connected to the fixing portion 57 in the longitudinal direction of the first supporting frame 31*a* and is recessed in an arc shape as seen in a plan view in the thickness direction of the first supporting frame 31*a*.

As shown in FIG. 9, with the rotary shaft 46 inserted in the supporting recess 58, the outer circumferential face of the rotary shaft 46 makes slidable contact with the inner circumferential face of the supporting recess 58 and is rotatably supported on the supporting recess 58. The rotary shaft 46 inserted in the shaft hole 47 can move between the fixing portion 57 and the supporting recess 58 by being slid on the second supporting frame 31*b* in the longitudinal direction (the arrow D3 direction in FIG. 8 or the arrow D4 direction in FIG. 9).

As shown in FIG. 8, when the rotary shaft 46 is inserted in the fixing portion 57 of the shaft hole 47, the flat faces 61 and the opposed faces 59 and 60 make contact with each other to restrict both forward and reverse rotation. When the roller supporting frame 31 is stretched to be kept in the second state, with the first and second supporting frames 31*a* and 31*b* linearly arranged, the rotary shaft 46 is slid in the arrow D4 direction together with the second supporting frame 31*b* to be inserted into the fixing portion 57.

As shown in FIG. 9, with the rotary shaft 46 inserted in the supporting recess 58, the first supporting frame 31*a* can be rotatable about the rotary shaft 46 in both the forward and reverse directions with respect to the second supporting frame 31*b*. Of the forward and reverse directions in which the first supporting frame 31*a* rotates, the direction that causes the obverse face 53 of the first supporting frame 31*a* to recede from the obverse face 53 of the second supporting frame 31*b* (the arrow D1 direction in the diagram) is taken as the forward direction and the opposite direction (the arrow D2 direction in the diagram) is taken as the reverse direction.

As shown in FIGS. 7 and 8, the rotary shaft 46 includes a projection 55 that projects from the outer circumferential face of the rotary shaft 46 outward in the radial direction. The projection 55 is formed downstream of the restricting wall portion 48 in the forward direction. As shown in FIG. 7, at a position on the vertical wall portion 49 overlapping with the projection 55 in the width direction of the first supporting frame 31*a*, a retraction recess 56 is formed. The retraction recess 56 is formed by cutting off part of the vertical wall portion 49 from its projection-direction tip end in the direction opposite to the projection direction.

Figure 10:
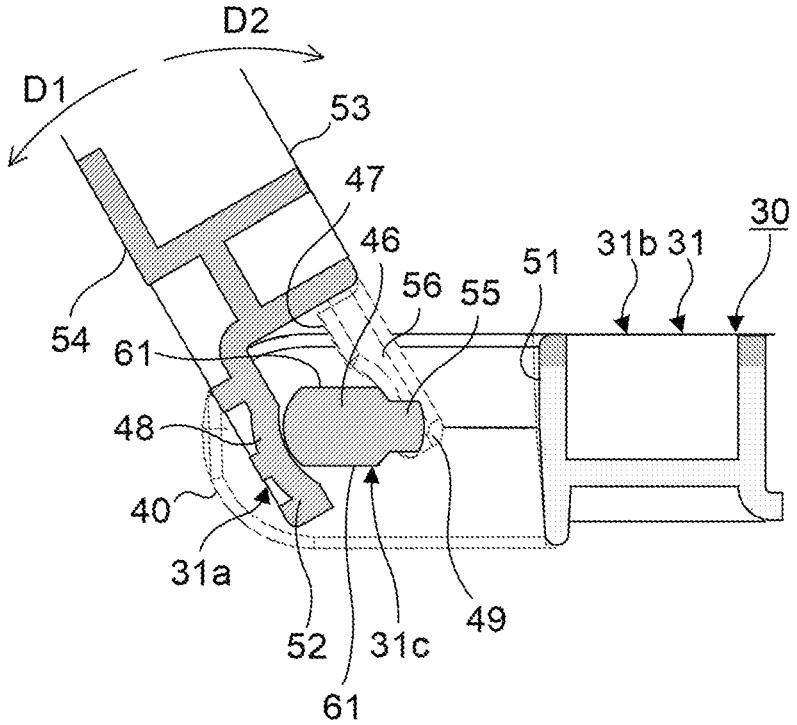
FIG. 10 is a cross-sectional view of the rotary shaft 46 when the first supporting frame 31*a* shown in FIG. 8 has rotated in the reverse direction.
Figure 11:
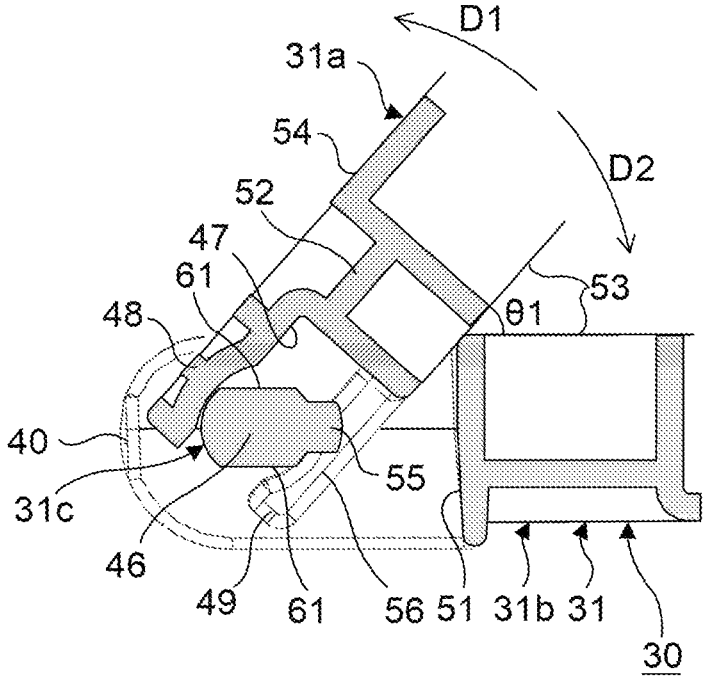
FIG. 11 is a cross-sectional view of the rotary shaft 46, showing a state where the angle between the first and second supporting frames 31*a* and 31*b* is an acute angle (the first state)
Figure 12:
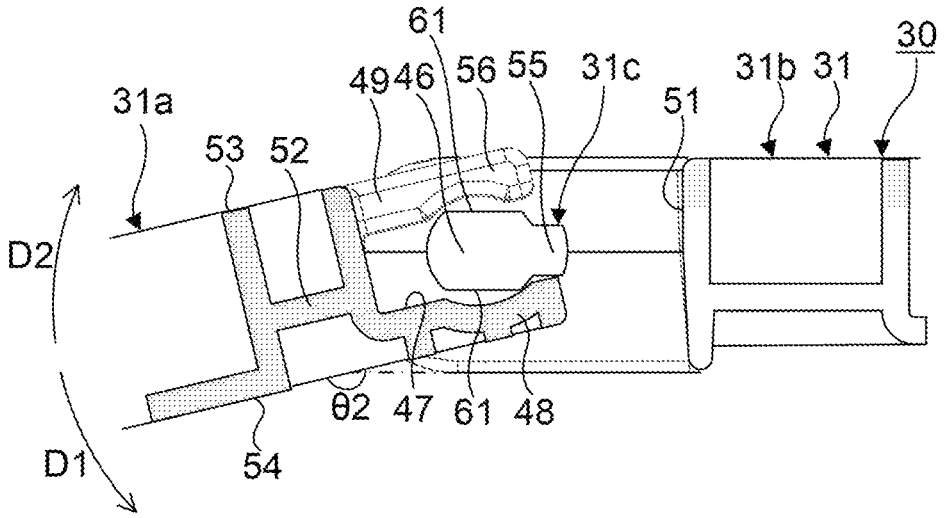
FIG. 12 is a cross-sectional view of the rotary shaft 46 when the first supporting frame 31*a* shown in FIG. 8 has rotated in the forward direction.

FIG. 10 is a cross-sectional view of the rotary shaft 46 when the first supporting frame 31*a* shown in FIG. 9 has rotated in the reverse direction. FIG. 11 is a cross-sectional view of the rotary shaft 46 showing a state where the first and second supporting frames 31*a* and 31 *b* form an acute angle (the first state). FIG. 12 is a cross-sectional view of the rotary shaft 46 when the first supporting frame 31*a* shown in FIG. 9 has rotated in the forward direction.

As shown in FIG. 8, when the roller supporting frame 31 is in the second state, the projection 55 is located between the restricting wall portion 48 and the vertical wall portion 49. Suppose that, from this state, as described above, the rotary shaft 46 is moved from the fixing portion 57 into the supporting recess 58 (see FIG. 9) and the first supporting frame 31*a* is rotated in the reverse direction (the arrow D2 direction); then, as shown in FIG. 10, the projection 55 enters the retraction recess 56.

When, from the state, the first supporting frame 31*a* is rotated further in the reverse direction (the arrow D2 direction), then, as shown in FIG. 11, the obverse face 53 of the first supporting frame 31*a* makes contact with part of the second supporting frame 31*b* (an edge portion between the coupling recess 51 and the obverse face 53 of the second supporting frame 31*b*). This contact restricts reverse rotation of the first supporting frame 31*a*. Here, the angle θ1 between the obverse face 53 of the first supporting frame 31*a* and the obverse face 53 of the second supporting frame 31*b* is equal to or larger than 30 degrees but equal to or smaller than 45 degrees (more preferably, equal to or larger than 35 degrees but equal to or smaller than 40 degrees).

By contrast, suppose that, with the roller supporting frame 31 in the second state, as described above, the rotary shaft 46 is moved from the fixing portion 57 into the supporting recess 58 (see FIG. 9) and the first supporting frame 31*a* is rotated in the forward direction (the arrow D1 direction); then, as shown in FIG. 12, the projection 55 makes contact with the restricting wall portion 48. This contact restricts forward rotation of the first supporting frame 31*a* Here, the angle θ2 between the reverse face 54 of the first supporting frame 31*a* and the reverse face 54 of the second supporting frame 31*b* is equal to or larger than 170 degrees but smaller than 180 degrees.

Figure 13:
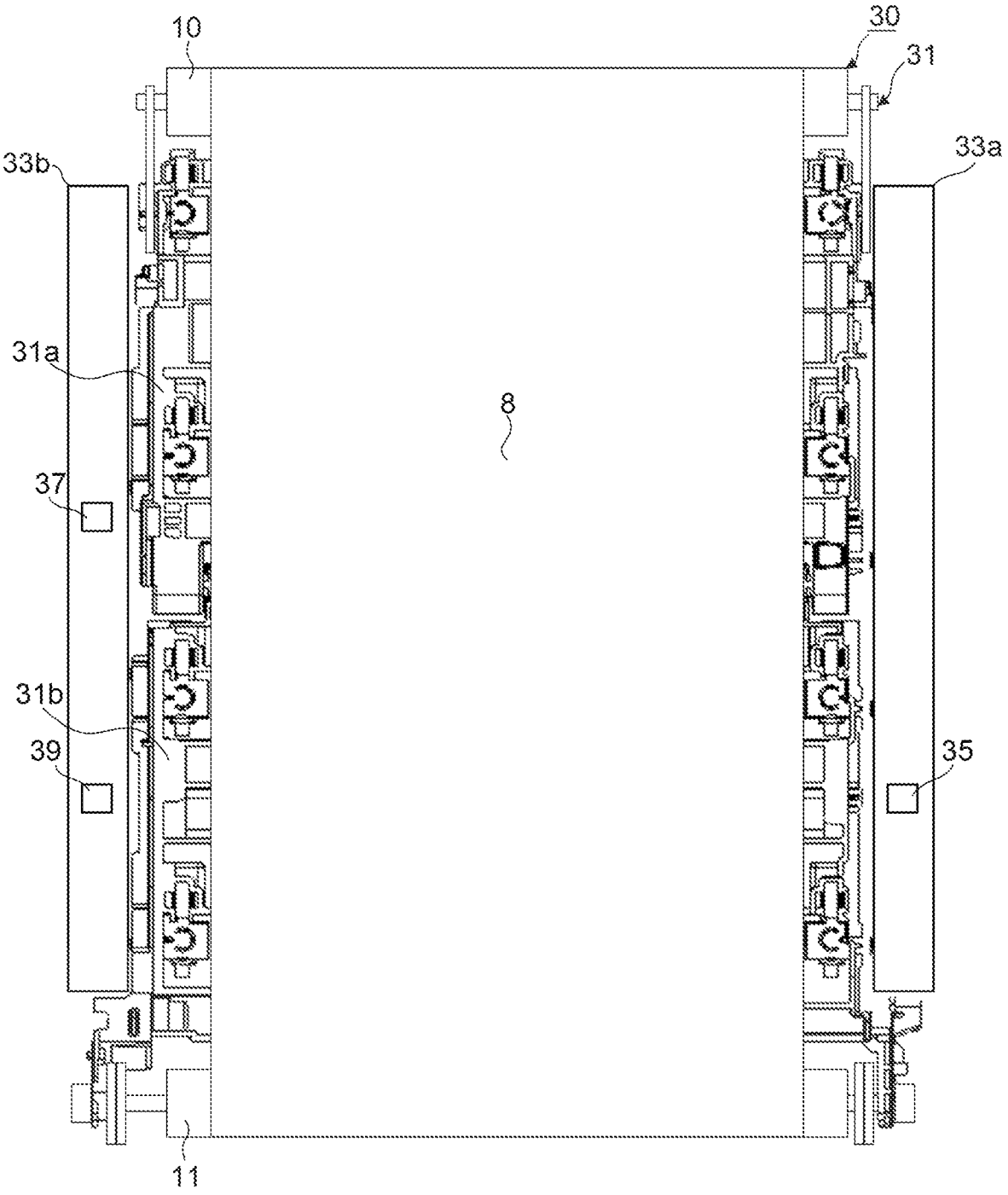
FIG. 13 is a plan view of the intermediate transfer unit 30 showing a state where a right side face frame 33*a* and a left side face frame 33*b* are respectively fitted to a right-side end part and a left-side end part of the roller supporting frame 31 in the width direction.

FIG. 13 is a plan view of the intermediate transfer unit 30 showing a state where a right side face frame 33*a* and a left side face frame 33*b* are respectively fitted to a right-side end part and a left-side end part of the roller supporting frame 31 in the width direction.

As shown in FIG. 13, on the right side face of the roller supporting frame 31 in the width direction, the right side face frame 33*a* is fitted. On the left side face of the roller supporting frame 31 in the width direction, the left side face frame 33*b* is fitted.

Provided on the top face of the right side face frame 33*a* is a development contact terminal portion 35 for electrically connecting a high-voltage circuit board (not shown) with the developing units 3*a* to 3*d* (see FIG. 1). Provided on the top face of the left side face frame 33*b* is a transfer contact terminal portion 37 for electrically connecting the high-voltage circuit board with the primary transfer rollers 6*a* to 6*d* and the secondary transfer roller 9 (see FIG. 1), and a charging contact terminal portion 39 for electrically connecting the high-voltage circuit board with the chargers 2*a* to 2*d* (see FIG. 1).

When the intermediate transfer unit 30 is inserted up to a predetermined position in the main body of the image forming apparatus 100, terminals (not shown) leading from the high-voltage circuit board makes contact with the development contact terminal portion 35, the transfer contact terminal portion 37, and the charging contact terminal portion 39 to allow biases to be applied to the developing units 3*a* to 3*d*, the primary transfer rollers 6*a* to 6*d*, the secondary transfer roller 9, and the chargers 2*a* to 2*d*.

Figure 14:
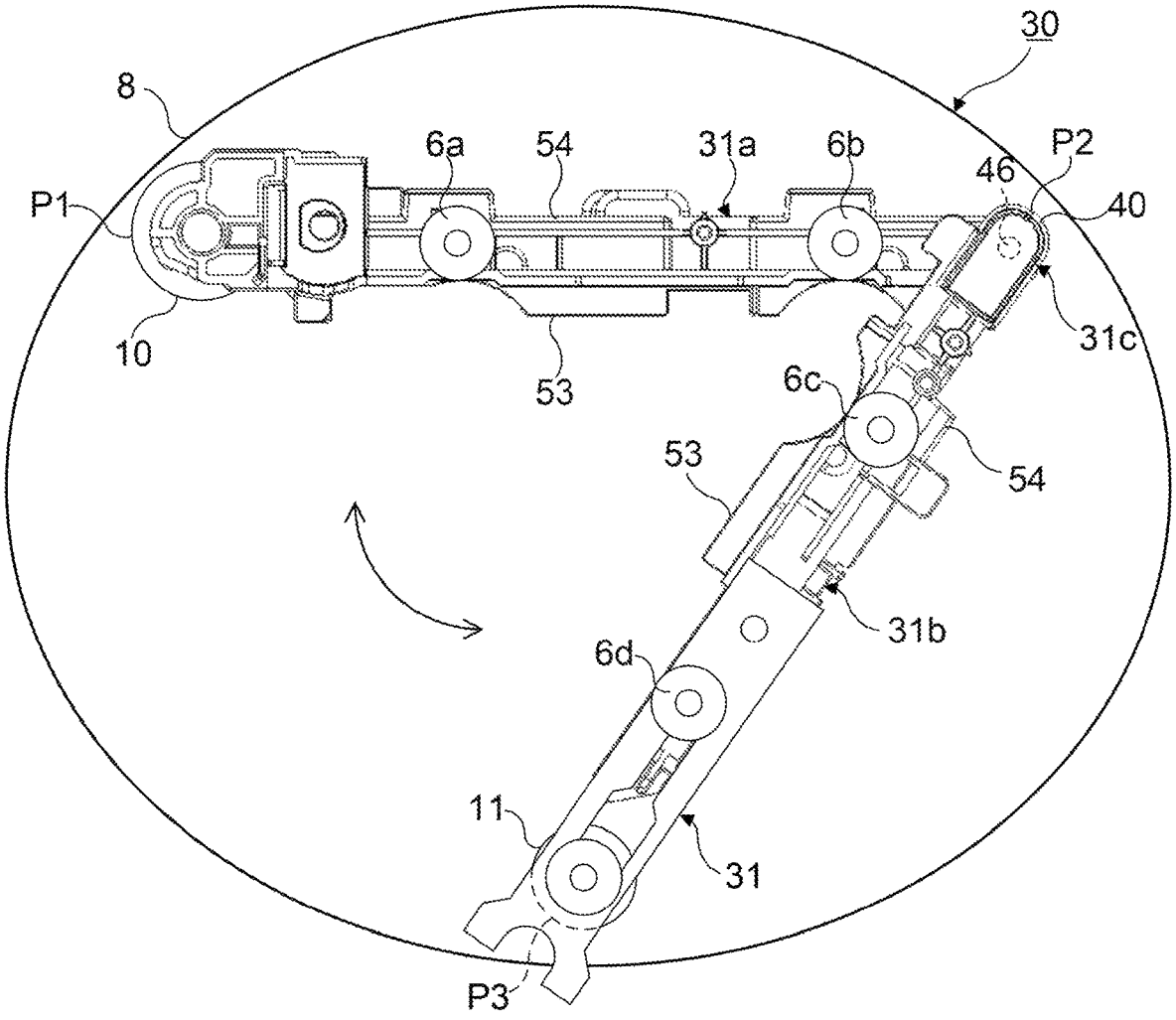
FIG. 14 is a side view of the roller supporting frame 31 in the second state.

Next, a procedure of assembling the intermediate transfer unit 30 will be described. FIG. 14 is a side view of the roller supporting frame 31 in the second state. First, as shown in FIG. 6, by rotating the first supporting frame 31*a* about the coupling portion 31*c* in the reverse direction with respect to the second supporting frame 31*b* so that the first and second supporting frames 31*a* and 31*b* approach each other, the roller supporting frame 31 is folded such that the angle between the first and second supporting frames 31*a* and 31*b* is an acute angle (the first state). Next, as shown in FIG. 14, the roller supporting frame 31 in the first state is inserted inside the intermediate transfer belt 8 deformed into a substantially circular shape as seen in a side view.

From this state (the state shown in FIG. 14), the first supporting frame 31*a* is rotated in the forward direction with respect to the second supporting frame 31*b* so that the first and second supporting frames 31*a* and 31*b* move away from each other. Then, the tension roller 10 supported on the first supporting frame 31*a* and the driving roller 11 supported on the second supporting frame 31*b* make contact with the inner circumferential face of the intermediate transfer belt 8. As the first and second supporting frames 31*a* and 31*b* are further pivoted relative to each other, the tension roller 10 and the driving roller 11 expands the inner circumferential face of the intermediate transfer belt 8.

The first and second supporting frames 31*a* and 31*b* are pivoted relative to each other until they extend linearly (second state). When the first and second supporting frames 31*a* and 31*b* are brought into the second state, the rotary shaft 46 slides in the longitudinal direction of the second supporting frame 31*b* to move into the fixing portion 57. As a result, rotation of the first and second supporting frames 31*a* and 31*b* is restricted both in the forward and reverse directions, and the roller supporting frame 31 is fixed in the stretched state (the second state).

Consequently, as shown in FIG. 3, the intermediate transfer belt 8 is wound flat around the tension roller 10 and the driving roller 11, and the primary transfer rollers 6*a* to 6*d* and the counter-roller 32 are in contact with the inner circumferential face of the intermediate transfer belt 8. Thereafter, the right side face frame 33*a* and the left side face frame 33*b* are fitted to the roller supporting frame 31. The assembly of the intermediate transfer unit 30 is thus completed.

The intermediate transfer unit 30 of the above embodiment can restrict rotation of the first and second supporting frames 31*a* and 31*b* to one direction by contact between the projection 55 formed on the rotary shaft 46 and the restricting wall portion 48 formed on the shaft hole 47. Thus, it is not necessary to provide a structure for restricting rotation on the obverse face 53 of the roller supporting frame 31, and it is possible, with a simple construction, to provide an intermediate transfer unit 30 that can prevent the intermediate transfer belt 8 from being scratched or creased during the assembly of the unit while suppressing an increase in its size. By incorporation of this intermediate transfer unit 30, it is possible to reduce the size of the image forming apparatus 100.

As shown in FIG. 14, as the roller supporting frame 31 in the first state which is inserted in the intermediate transfer belt 8 is stretched, the outer face (reverse face 54) of the folded roller supporting frame 31 makes contact with the inner circumferential face of the intermediate transfer belt 8 and expands the intermediate transfer belt 8 while deforming it into substantially a triangular shape as seen in a side view. Meanwhile, of the intermediate transfer belt 8 that is being expanded into a triangular shape, three vertex portions (P1, P2, and P3 shown in FIG. 14) are subjected to an especially heavy load.

Edge portions of the tip ends of the restricting wall portion 48 and the vertical wall portion 49 in the projection direction are round-chamfered. With this construction, even when, as the roller supporting frame 31 is stretched, the inner circumferential face of the intermediate transfer belt 8 makes contact with the tip end portions of the restricting wall portion 48 and the vertical wall portion 49 in the projection direction, the intermediate transfer belt 8 slides on them smoothly, and thus the load in the direction to bend the intermediate transfer belt 8 along the width direction is reduced; thus, it is possible to prevent the intermediate transfer belt 8 from being scratched on the inner circumferential face or creased in the width direction.

As described above, when, during folding of the roller supporting frame 31, the first supporting frame 31*a* makes contact with the second supporting frame 31*b* to restrict rotation in the reverse direction, the angle θ1 between the obverse face 53 of the first supporting frame 31*a* and the obverse face 53 of the second supporting frame 31*b* is equal to or larger than 30 degrees but equal to or smaller than 45 degrees (more preferably, equal to or larger than 35 degrees but equal to or smaller than 40 degrees). In this way, it is possible to let the roller supporting frame 31 in the folded state stand with the first and second supporting frames 31*a* and 31*b* serving as legs. Thus, it is possible to improve the ease of stretching the intermediate transfer belt 8.

Of the three vertex portions P1, P2, and P3 of the intermediate transfer belt 8 shown in FIG. 14, the tension roller 10 and the driving roller 11 make contact with the vertex portions P1 and P3 respectively; thus there is no risk of the intermediate transfer belt 8 being scratched on the inner circumferential face or being bent. On the other hand, at the vertex portion P2, the outer face of the coupling portion 31*c* rubs against the inner circumferential face of the intermediate transfer belt 8. Also the outer face of the coupling portion 31*c* presses the intermediate transfer belt 8 from inside; thus a load acts on the intermediate transfer belt in such a direction as to bend it along the width direction.

Thus, in the above embodiment, an arc-shaped sliding face 40 as seen in aside view is formed on the outer face of the coupling portion 31*c* in the roller supporting frame 31 (see FIG. 14). Specifically, the sliding face 40 is formed on an end portion of the second supporting frame 31*b*, which constitutes the outer face of the coupling portion 31*c*. With this construction, as the roller supporting frame 31 is stretched, the inner circumferential face of the intermediate transfer belt 8 and the sliding face 40 slide on each other smoothly, and the load in such a direction as to bend the intermediate transfer belt 8 along the width direction is reduced. Thus, it is possible to prevent the intermediate transfer belt 8 from being scratched on the inner circumferential face or being creased in the width direction.

The embodiment described above is in no way meant to limit the present disclosure, which thus allows for many modifications and variations within the spirit of the present disclosure. For example, the rotary shaft 46 may be formed on the second supporting frame 31*b* and the shaft hole 47 may be formed on the first supporting frame 31*a*.

Although, in the embodiment, the tension roller 10 is supported on the first supporting frame 31*a* and the driving roller 11 is supported on the second supporting frame 31*b*, this is not meant as any limitation. For example, it is also possible to adopt a construction in which the tension roller 10 is supported on the first supporting frame 31*a* and the driving roller 11 is supported on the second supporting frame 31*b*.

In the embodiment, when the roller supporting frame 31 is folded by rotating the first supporting frame 31*a* in the reverse direction, by bringing the obverse face 53 of the first supporting frame 31*a* into contact with part of the second supporting frame 31*b* (an edge portion between the coupling recess 51 and the obverse face 53 of the second supporting frame 31*b*), rotation of the first supporting frame 31*a* in the reverse direction is restricted. However, this is not meant as any limitation. For example, a construction is also possible where rotation of the first supporting frame 31*a* with respect to the second supporting frame 31*b* in the reverse direction is restricted by forming on the obverse face 53 of the first supporting frame 31*a* and the obverse face 53 of the second supporting frame 31*b* projections that project along the plane so that these projections make contact with each other when the roller supporting frame 31 is folded. In this case, it is preferable that these projections be so high as not to make contact with the inner circumferential face of the intermediate transfer belt 8 and that their tip end portions in the projection direction be chamfered.

The application of the present disclosure is not limited to a tandem-type color printer as shown in FIG. 1. The present disclosure is applicable also to various types of image forming apparatuses using an intermediate transfer unit, such as color copiers, color multifunction peripherals, and facsimile machines.

The present disclosure is usable in an intermediate transfer unit including an endless intermediate transfer belt. Based on the present disclosure, it is possible to provide an intermediate transfer unit that can prevent an intermediate transfer belt from being scratched or creased during the assembly of the unit while suppressing an increase in its size.

What is claimed is:

1. An intermediate transfer unit comprising:

an endless intermediate transfer belt that moves along a plurality of image forming portions;

a driving roller that rotates the intermediate transfer belt;

a tension roller that rotates by following the intermediate transfer belt while giving a predetermined tension to the intermediate transfer belt; and a roller supporting frame including a first supporting frame which supports on one end thereof one of the tension roller and the driving roller and a second supporting frame which supports on one end thereof another of the tension roller and the driving roller, the roller supporting frame having a coupling portion formed thereon which rotatably couples together an end part of the first supporting frame on which the one roller is not supported and an end part of the second supporting frame on which the other roller is not supported, wherein the coupling portion has a rotary shaft formed on the first supporting frame and a shaft hole formed in the second supporting frame to permit the rotary shaft to be inserted therein, the roller supporting frame is inserted inside the intermediate transfer belt in a first state where the first and second supporting frames are folded so as to form an acute angle, the roller supporting frame making the first supporting frame rotate with respect to the second supporting frame about the rotary shaft in a forward direction such that the roller supporting frame in the first state is brought into a second state where the first and second supporting frames extend linearly, the roller supporting frame having the intermediate transfer belt wound around the driving roller and the tension roller, the rotary shaft has a projection that projects from an outer circumferential face thereof in a radial direction, the shaft hole has a restricting wall portion which is formed outward of the rotary shaft in the radial direction, downstream of the projection in the forward direction, and as the first supporting frame in the second state rotates in the forward direction, the projection makes contact with the restricting wall portion to restrict rotation of the first supporting frame in the forward direction.

2. The intermediate transfer unit according to claim 1, wherein the shaft hole has a vertical wall portion that faces the restricting wall portion in the radial direction and a retraction recess that is recessed, from a tip end portion of the vertical wall portion in the forward direction, in a direction opposite to the forward direction, and the projection is, in the second state, located outside the retraction recess, and, as the first supporting frame in the second state rotates in the reverse direction, the projection enters the retraction recess.

3. The intermediate transfer unit according to claim 2, wherein outer circumferential edges of the restricting wall portion and the vertical wall portion are chamfered.

4. The intermediate transfer unit according to claim 1, wherein when the roller supporting frame is in the first state, an interior angle between the first and second supporting frames is equal to or larger than 30 degrees but equal to or smaller than 45 degrees.

5. The intermediate transfer unit according to claim 1, wherein an arc-shaped sliding face as seen in a side view is formed on an end portion of the second supporting frame that constitutes an outer face of the coupling portion.

6. An image forming apparatus comprising:

the intermediate transfer unit according to claim 1; and the plurality of image forming portions each including an image carrying member that makes contact with the outer circumferential face of the intermediate transfer belt to transfer a toner image.

* * * * *